US011802423B2

(12) United States Patent
Chen

(10) Patent No.: US 11,802,423 B2
(45) Date of Patent: Oct. 31, 2023

(54) DOOR LOCK

(71) Applicant: Jeff Chen, Chiayi (TW)

(72) Inventor: Jeff Chen, Chiayi (TW)

( * ) Notice: Subject to any disclaimer, the term of this patent is extended or adjusted under 35 U.S.C. 154(b) by 80 days.

(21) Appl. No.: 17/515,710

(22) Filed: Nov. 1, 2021

(65) Prior Publication Data

US 2023/0134746 A1 May 4, 2023

(51) Int. Cl.

| | |
|---|---|
| ***E05B 47/00*** | (2006.01) |
| ***E05B 55/00*** | (2006.01) |
| ***E05B 63/08*** | (2006.01) |
| ***E05B 47/02*** | (2006.01) |
| ***E05B 63/00*** | (2006.01) |

(52) U.S. Cl.

CPC ..... *E05B 47/0012* (2013.01); *E05B 47/026* (2013.01); *E05B 55/005* (2013.01); *E05B 63/08* (2013.01); *E05B 63/0056* (2013.01)

(58) Field of Classification Search

CPC .. E05B 47/00; E05B 47/0001; E05B 47/0012; E05B 47/0013; E05B 47/026; E05B 2047/0087; E05B 2047/0014; E05B 2047/0015; E05B 2047/0016; E05B 2047/0017; E05B 2047/002; E05B 2047/0022; E05B 55/00; E05B 55/005; E05B 63/00; E05B 63/08; E05B 63/10; E05B 63/0056

USPC ..... 70/277

See application file for complete search history.

(56) References Cited

U.S. PATENT DOCUMENTS

| | | | | |
|---|---|---|---|---|
| 9,500,005 | B2 * | 11/2016 | Chen | E05B 47/0012 |
| 2009/0000342 | A1 * | 1/2009 | Chen | E05B 63/16 70/224 |
| 2009/0058596 | A1 * | 3/2009 | Sohanta | E05B 17/0058 340/5.53 |

* cited by examiner

*Primary Examiner* — Nathan Cumar

(57) ABSTRACT

A door lock contains: a casing, a head, a first clutch element, a second clutch, a drive gear, a gear assembly, a guide rod, a locking column, and a holder. The casing includes a first connection part and a second connection part. The head includes a retainer, a first engagement portion, and a receiving orifice. The first clutch element includes a groove. The second clutch element includes a driving orifice, a limitation protrusion, and an abutting segment. The drive gear includes a defining trench. The gear assembly includes a driven gear, a motor, a transmission gear, a first meshing gear, and a second meshing gear. The guide rod includes a toothed section, a guiding stem, a tongue, and a resilient element. The locking column includes a cross section in a square shape. The holder includes an extending sheet, a fixing orifice, a fitting sleeve, and a first through orifice.

3 Claims, 5 Drawing Sheets

DOOR LOCK

FIELD OF THE INVENTION

The present invention relates to a door lock which is operated easily.

BACKGROUND OF THE INVENTION

A conventional door lock does not have the function of idling lock, which makes it difficult to open the door when escaping, thus causing the disadvantage of trapping The present invention has arisen to mitigate and/or obviate the afore-described disadvantages.

SUMMARY OF THE INVENTION

The primary aspect of the present invention is to provide a door lock by which the head of the door lock actuates the first engagement portion to engage with or remove from the groove of the first clutch element so that the limitation protrusion of the second clutch element guides the drive gear to actuate the gear assembly, and the gear assembly meshes with the toothed section of the guide rod or rotates idly, such that after the toothed section of the guide rod is actuated by the gear assembly and the key is rotated clockwise or counterclockwise, the tongue is controlled by the key to retract inward or extend back to an original position, wherein when the key is rotated idly, the motor drives the tongue to unlock a door easily.

DETAILED DESCRIPTION OF THE PREFERRED EMBODIMENTS

Figure 1:
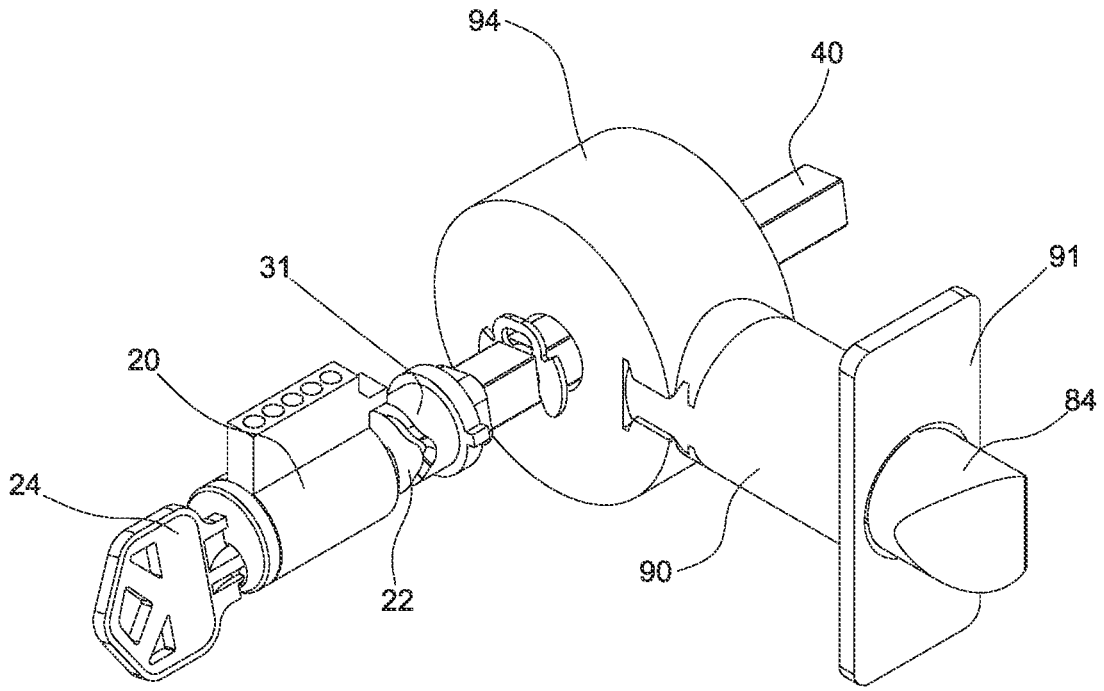
FIG. 1 is a perspective view showing the assembly of a door lock according to a preferred embodiment of the present invention.
Figure 2:
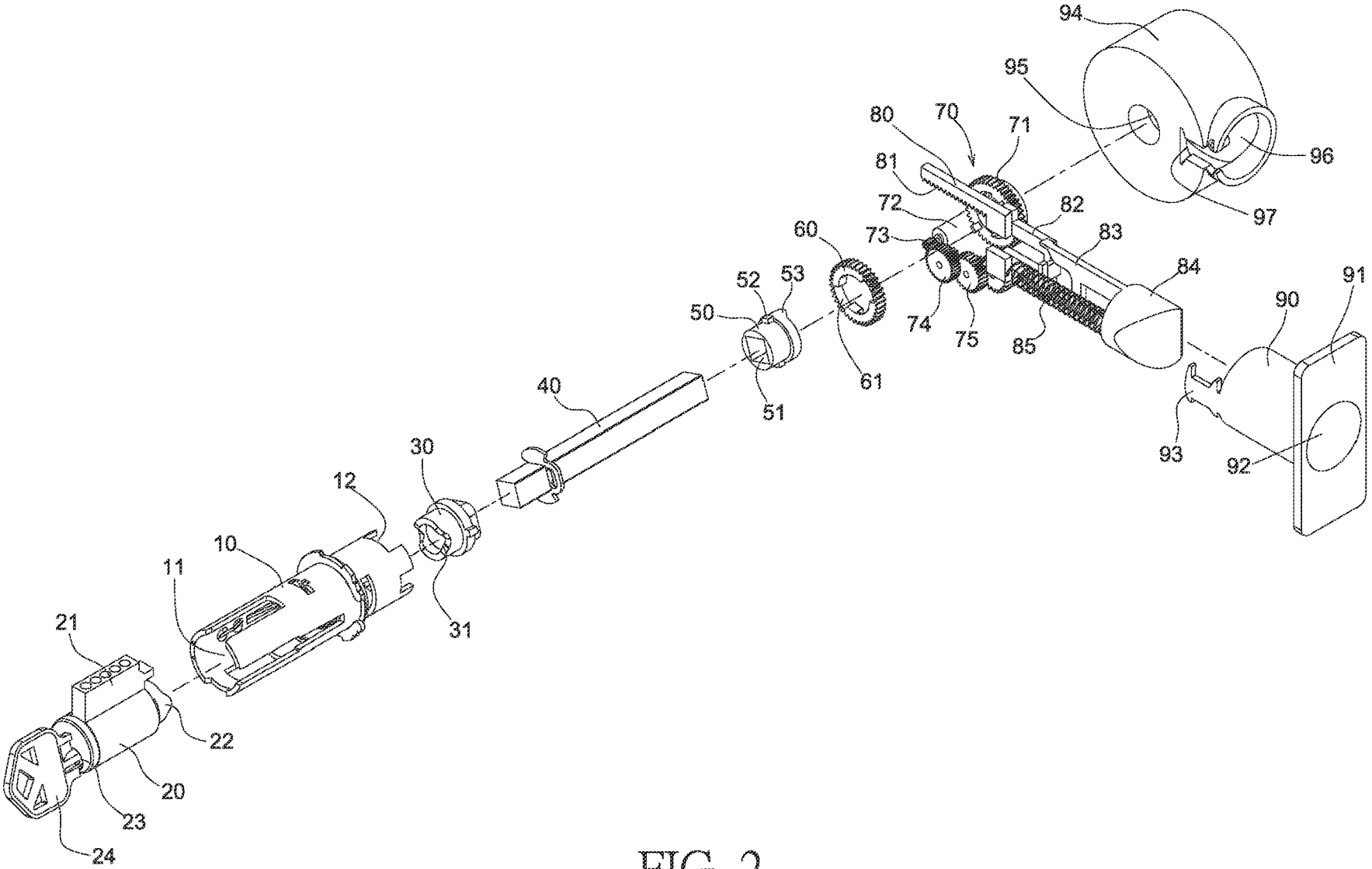
FIG. 2 is a perspective view showing the exploded components of the door lock according to the preferred embodiment of the present invention.
Figure 3:
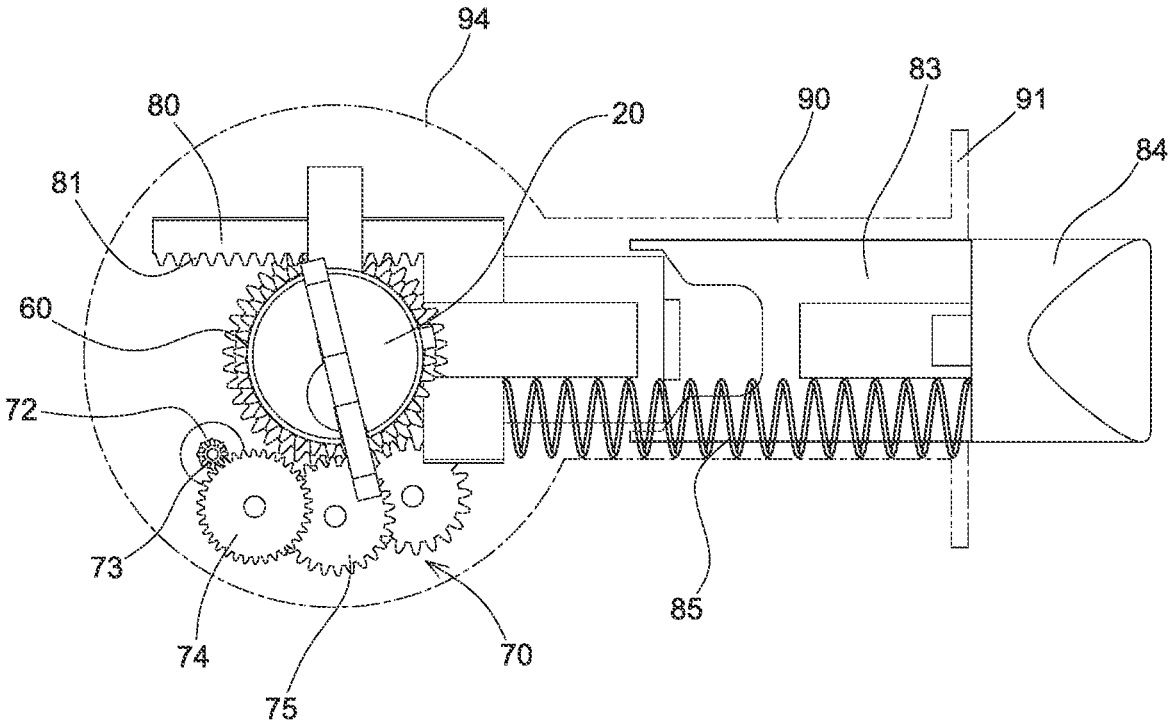
FIG. 3 is a side plan view showing the operation of the door lock according to the preferred embodiment of the present invention.
Figure 4:
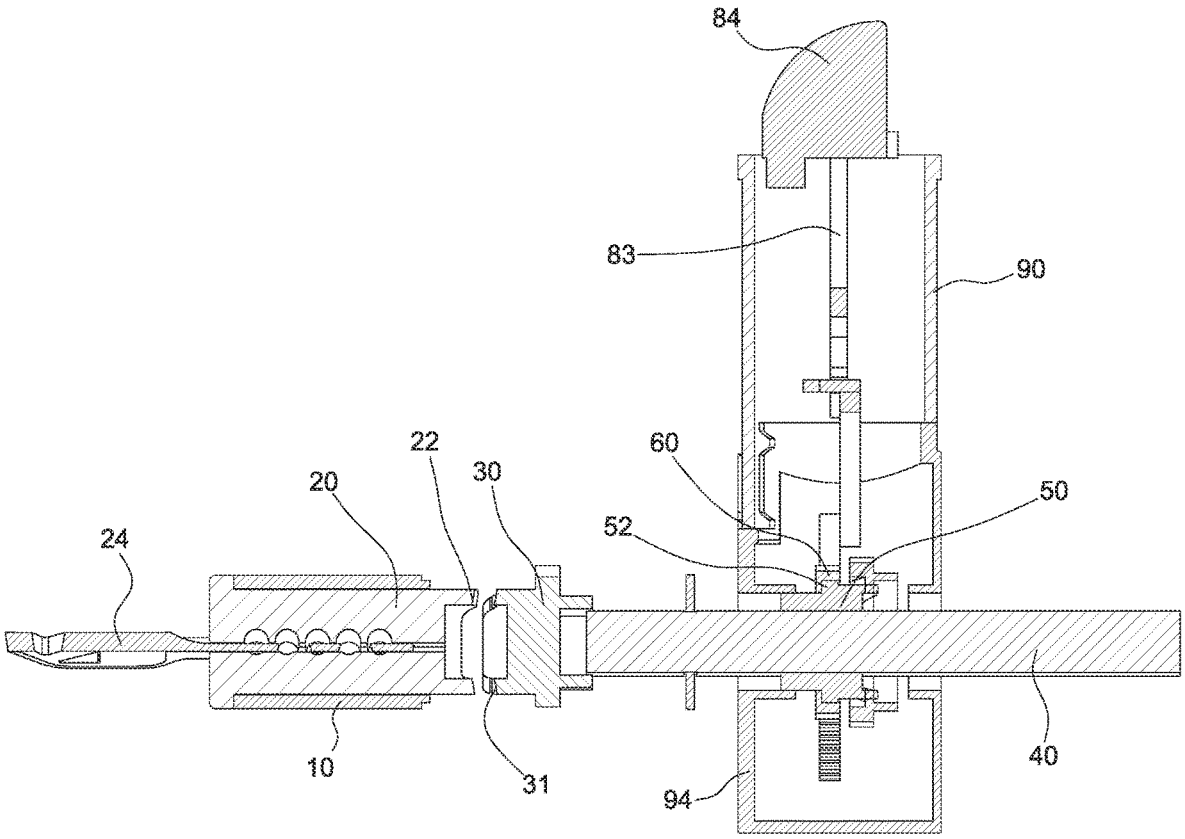
FIG. 4 is a cross sectional view showing the operation of the door lock according to the preferred embodiment of the present invention.
Figure 5:
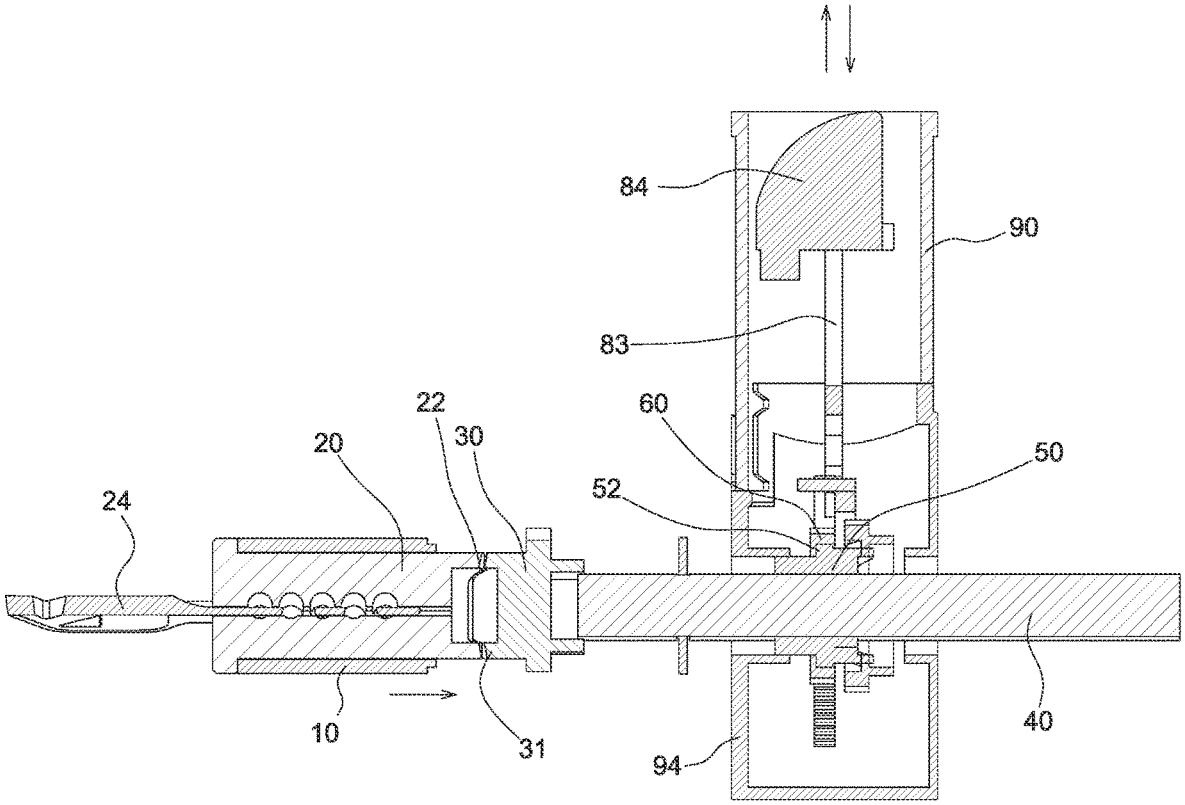
FIG. 5 is another cross sectional view showing the operation of the door lock according to the preferred embodiment of the present invention.

With reference to FIGS. 1-5, a door lock according to a preferred embodiment of the present invention comprises:

a casing 10 including a first connection part 11 and a second connection part 12;

a head 20 connected with the first connection part 11 and including a retainer 21 formed on an outer wall of the head 20, a first engagement portion 22 formed on a first end of the head 20 and corresponding to the casing 10, a receiving orifice 23 defined on a second end of the head 20, wherein the receiving orifice 23 is configured to receive a key 24;

a first clutch element 30 including a groove 31 defined on a first end of the first clutch element 30 and corresponding to the first engagement portion 22 of the head 20, wherein when the groove 31 of the first clutch element 30 is engaged with the first engagement portion 22, the first clutch 30 is connected with the first connection part 12 of the casing 10;

a second clutch element 50 located opposite to the first clutch element 30, and the second clutch element 50 including a driving orifice 51 formed on a center of the second clutch element 50, a limitation protrusion 52 extending from an outer wall of the second clutch element 50, and an abutting segment 53 extending from an end of the second clutch element 50 opposite to the driving orifice 51;

a drive gear 60 located opposite to the second clutch element 50 and including a defining trench 61 configured to engage with or remove from the limitation protrusion 52 of the second clutch element 50;

a gear assembly 70 fixed opposite to the drive gear 60, and the gear assembly 70 including a driven gear 71, a motor 72, a transmission gear 73 mounted on an end of the motor 72, a first meshing gear 74 configured to mesh with the transmission gear 73, and a second meshing gear 75 configured to mesh with the first meshing gear 74;

a guide rod 80 including a toothed section 81 configured to mesh with the drive gear 60, an actuation post 82 arranged on a first end of the guide rod 80, a guiding stem 83 connected with the actuation post 82, a tongue 84 formed on the guiding stem 83 opposite to the actuation post 82, and a resilient element 85 secured on a side of the tongue 84 opposite to the gear assembly 70;

a locking column 40 including a cross section formed in a square shape and inserted through the second clutch element 50, the drive gear 60, and the gear assembly 70;

a holder 90 including an extending sheet 91 extending from a first end of the holder 90 opposite to the tongue 84, a fixing orifice 92 passing through the extending sheet 91 and the holder 90 and connected with the tongue 84, a fitting sleeve 94 fitted on a second end of the holder 90 and connected with the gear assembly 70, a first through orifice 95 defined on a center of an end of the fitting sleeve 94 and receiving the locking column 40, a second engagement portion 93 extending from the second end of the holder 90, a second through orifice 96 defined on a side wall of the fitting sleeve 94 opposite to the holder 90, and a cutout 97 defined beside and communicating with the second through orifice 96 so as to engage with the second engagement portion 93 of the holder 90.

In operation, the head 20 of the door lock actuates the first engagement portion 22 to engage with or remove from the groove 31 of the first clutch element 30 so that the limitation protrusion 52 of the second clutch element 50 guides the drive gear 60 to actuate the gear assembly 70, and the gear assembly 70 meshes with the toothed section 81 of the guide rod 80 or rotates idly. After the toothed section 81 of the guide rod 80 is actuated by the gear assembly 70 and the key 24 is rotated clockwise or counterclockwise, the tongue 84 is controlled by the key 24 to retract inward or extend back to an original position, wherein when the key 24 is rotated idly, the motor 72 drives the tongue 84 to unlock a door.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A door lock comprising:

a casing including a first connection part and a second connection part;

a head connected with the first connection part of the casing and including a retainer formed on an outer wall of the head, a first engagement portion formed on a first end of the head and corresponding to the casing, and a receiving orifice defined on a second end of the head;

a first clutch element including a groove defined on a first end of the first clutch element and corresponding to the first engagement portion of the head;

a second clutch element located opposite to the first clutch element, and the second clutch element including a driving orifice formed on a center of the second clutch element, a limitation protrusion extending from an outer wall of the second clutch element, and an abutting segment extending from an end of the second clutch element, wherein when the groove of the first clutch element is engaged with the first engagement portion, the second clutch element is connected with the first connection part of the casing;

a drive gear located opposite to the second clutch element and including a defining trench configured to engage with or remove from the limitation protrusion of the second clutch element;

a gear assembly fixed opposite to the drive gear, and the gear assembly including a driven gear, a motor, a transmission gear mounted on an end of the motor, a first meshing gear configured to mesh with the transmission gear, and a second meshing gear configured to mesh with the first meshing gear;

a guide rod including a toothed section configured to mesh with the drive gear, an actuation post arranged on a first end of the guide rod, a guiding stem connected with the actuation post, a tongue formed on the guiding stem opposite to the actuation post, and a resilient element secured on a side of the tongue opposite to the gear assembly;

a locking column including a cross section formed in a square shape and inserted through the second clutch element, the drive gear, and the gear assembly; and a holder including an extending sheet extending from a first end of the holder opposite to the tongue, a fixing orifice passing through the extending sheet and the holder and connected with the tongue, a fitting sleeve fitted on a second end of the holder and connected with the gear assembly, and a first through orifice defined on a center of an end of the fitting sleeve and receiving the locking column.

2. The door lock as claimed in claim 1, wherein the receiving orifice of the head is configured to receive a key.

3. The door lock as claimed in claim 1, wherein the holder further includes a second engagement portion extending from the second end of the holder, a second through orifice defined on a side wall of the fitting sleeve opposite to the holder, and a cutout defined beside and communicating with the second through orifice so as to engage with the second engagement portion of the holder.

* * * * *